United States Patent [19]

Hardy et al.

[11] Patent Number: 4,675,579

[45] Date of Patent: Jun. 23, 1987

[54] COUPLING OF CARRIER SIGNAL FROM POWER LINE

[75] Inventors: James H. Hardy; Daniel V. Owen, both of Hendersonville; Candler A. Willis, Zirconia, all of N.C.

[73] Assignee: General Electric Company, Schenectady, N.Y.

[21] Appl. No.: 713,218

[22] Filed: Mar. 18, 1985

[51] Int. Cl.[4] ..... H05B 41/38

[52] U.S. Cl. ..... 315/318; 315/DIG. 4; 340/310 R; 340/310 A

[58] Field of Search ..... 340/310 R, 310 A; 315/244, 312, 318, DIG. 4; 324/58 R, 58 B, 58.5 R, 58.5 B

[56] References Cited

U.S. PATENT DOCUMENTS

| | | | |
|---|---|---|---|
| 2,212,721 | 8/1940 | Terroni | 340/310 R |
| 2,300,940 | 11/1942 | Lenehan | 340/310 R |
| 2,924,769 | 2/1960 | Harriman et al. | 324/58 R |
| 3,924,223 | 12/1975 | Whyte et al. | 340/310 R |
| 4,523,128 | 6/1985 | Stamm et al. | 315/247 |

FOREIGN PATENT DOCUMENTS

| | | | |
|---|---|---|---|
| 562986 | 7/1944 | United Kingdom | 340/310 |

*Primary Examiner*—Samuel Scott
*Assistant Examiner*—Noah Kamen
*Attorney, Agent, or Firm*—John P. McMahon; Philip L. Schlamp; Fred Jacob

[57] ABSTRACT

The AC power line to a street luminaire carries a 200 KHz carrier signal for operating a switching relay that connects a dimming reactor in series with the discharge lamp. A pick-off transformer has a primary winding connected in series with the ballasting means for the lamp, and a secondary winding connected to a carrier signal detector operating the switching relay. A capacitor connected across the primary has a value resonating the primary magnetizing reactance of the transformer at the carrier frequency. A resistor substantially higher in value than the characteristic impedance of the line but not several orders of magnitude higher, is preferably connected across the primary winding to serve as a terminating impedance.

10 Claims, 4 Drawing Figures

COUPLING OF CARRIER SIGNAL FROM POWER LINE

The invention relates to a circuit for coupling a carrier signal from a power line into a utilization circuit, and more particularly to such a circuit for coupling the carrier signal into a receiver suitable for the control of street lights.

BACKGROUND OF THE INVENTION

Carrier signals on power transmission lines have long been used by electric utilities as a means of communication between power stations. The radio frequency (RF) carrier is generally coupled to and from the high voltage line by series capacitors which block the 60 Hz high tension voltage and pass the high frequency low voltage carrier signal. In such applications, the carrier communication system represents but a minuscule fraction of the total investment of the utility so that there has been no great need for economy in equipment design.

More recently, in large part as a result of the general desire for economy in utilization of energy, the need for centralized remote control and night-time dimming of street lights has developed. City street lights are frequently energized in groups of up to 50 on 230 volt, 60 Hz A.C. power lines. One or more such lines may radiate from local controller boxes scattered throughout the city. The main breaker in the controller box is operated, either by clockwork or by remote control, to turn the lights on or off. For dimming lights such as high pressure sodium vapor or metal halide lamps, it is necessary to connect additional reactance into the lamp circuit at each individual luminaire. It has been proposed to do this by generating and coupling an RF carrier signal or tone into the power line at the controller box to cause the operation of a relay switching the dimming reactance into circuit in each individual luminaire.

SUMMARY OF THE INVENTION

An object of the invention is to provide a new, reliable and economical circuit for coupling an RF carrier signal or tone from an AC power line into a utilization circuit. Another object is to provide a coupling scheme which can accommodate a variable number of randomly spaced loads. A more specific object is to provide a new and improved circuit particularly adapted to coupling an RF carrier signal from a 60 Hz power line for street lights into receivers or tone detectors contained in randomly spaced luminaires and suitable for the control of lamp brightness.

In accordance with our invention, an inductive device tuned to anti-resonance at the carrier signal frequency is inserted in series with at least a portion of the discharge lamp operating circuit which presents a low capacitive impedance to the carrier signal, and means are provided to couple the carrier signal developed across the device to a utilization circuit.

In one circuit embodying the invention, the inductive device, conveniently referred to as a pick-off transformer, comprises a high current capacity primary winding which is connected in series with the ballast transformer or reactor serving the discharge lamp, and a secondary winding. The primary comprises few turns and has adequate capacity to carry the lamp load current. A capacitor is connected across the primary winding and has a value resonating the primary magnetizing reactance at the carrier signal frequency, typically 200 KHz. Thus the carrier signal is made to appear across the transformer with little loading of the line and it is supplied by the secondary winding to the utilization circuit. A terminating impedance of predetermined value selected to assure a minimum signal level at each luminaire notwithstanding standing waves on the line, is connected across the primary of the pick-off transformer.

In a preferred embodiment, the secondary winding supplies the carrier signal through a series loading resistor to a tuned L-C or tank circuit and thence to a peak detector circuit. The signal at the peak detector is amplified by one or more differentially connected operational amplifiers and controls switching means such as a relay which switches a dimming reactor in or out of circuit.

DETAILED DESCRIPTION

Figure 1:
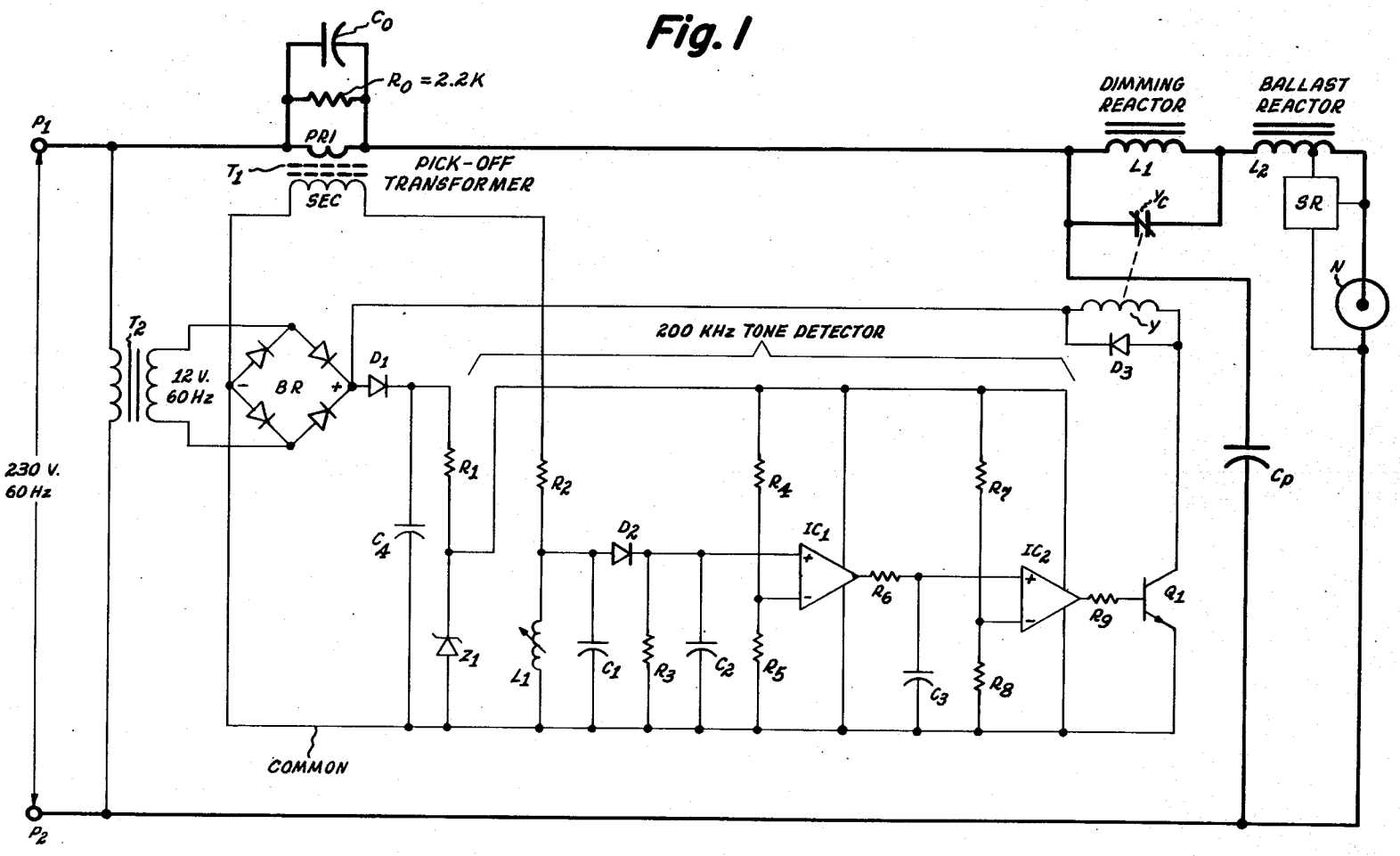
FIG. 1 is a schematic diagram of a lamp operating and dimming circuit contained in a street luminaire including a carrier signal or tone pick-off transformer and detector circuit embodying the invention in preferred form.

Referring to FIG. 1 of the drawings, terminals $P_1$, $P_2$ represent the luminaire line terminals to which the 230 volt, 60 Hz street lighting or power line is connected to energize the lamp operating circuit contained in the luminaire. The power line may run from a local controller box and be carried in underground ducts or, in less densely built-up areas, on overhead poles. Typically up to 50 street lights may be serviced by one line of 100 ampere capacity originating at a 20 kilowatt controller box. Preferably the carrier is generated at the local controller box and is turned on when it is desired to dim the lights. A carrier signal or tone, by way of example at a level of 5 volts and a frequency of 200 KHz, may be supplied to the line in addition to the 230 volt, 60 Hz power. In the description to follow, the parenthetically indicated component values have been found suitable for such an arrangement.

The incoming line current passes through the primary of pick-off transformer $T_1$, dimming reactor $L_1$ which may be short-circuited by the normally closed contacts $Y_c$ of relay Y, ballast reactor $L_2$, and high intensity discharge lamp N, all connected in series. A power factor correcting capacitor $C_p$, typically of 35 microfarads capacity and 300 volts rating, may be hung across the line in some of the luminaires in order to raise the power factor. A popular lamp for lighting of city streets is a 310 watt high pressure sodium vapor lamp which lamp requires a high voltage high frequency pulse starter. Such starter is well-known and is here conventionally represented by block SR having a tap connection at the output end of ballast reactor $L_2$ and connections to both sides of the lamp. In normal operation of the lamp at full brightness, the current through it is approximately 3 amperes. When relay contacts $Y_c$ are opened, dimming reactor $L_1$ is placed in series and reduces the lamp current and the light output to about half.

Due to their distributed capacitance, both dimming reactor $L_1$ and ballast reactor $L_2$ appear capacitive at the carrier signal or tone frequency of 200 KHz. As a result, whether or not a power factor correcting capacitor $C_p$ is provided, the carrier signal would see a low capacitive input impedance. In order to protect the carrier signal from such low impedance which would otherwise clamp it to near zero, a tuning capacitor $C_o$ is connected in parallel with the primary of $T_1$ which has a ferrite core for low losses at radio frequencies. Capacitor $C_o$ has a value resonating the primary magnetizing reactance of $T_1$ at the carrier signal frequency. Thus the carrier signal sees a high impedance and is developed across the primary winding of $T_1$ with little loading. The carrier signal is coupled out to the tone detector circuit by the secondary winding. With this arrangement it is necessary of course for the primary to carry the full luminaire current which may be as much as 3 amperes when no power factor connecting capacitor is provided. However this burden is not severe because only a few turns are required. By way of example, for a 200 KHz carrier signal, a transformer $T_1$ having a 12 turn primary over a 30 turn secondary on a shell type ferrite core was used and the value of $C_o$ for resonance was 0.01 UFD.

While the pick-off transformer shown in FIG. 1 is connected in series with the dimming reactor $L_1$ and the ballast reactor $L_2$, other equivalent arrangements may be used. The pick-off transformer primary may be connected in series with a portion only of the ballasting means where such ballasting means consists of several components, for instance a pair of primary windings which may be connected in parallel or in series to accommodate different line voltages. Other ways of connecting the primary winding in series with at least a portion of said lamp circuit which presents a low capacitive impedance to the carrier signal will serve our purpose. For instance the pick-off transformer primary may be connected in series with the power factor connecting capacitor $C_p$ in the lamp circuit.

When several loads are connected across a transmission line which is long relative to the wavelength of the electric wave applied to it, the choice of load impedance is critical since it will affect the standing wave pattern on the line, the maximum number of loads the line can accommodate, and the transmission efficiency. It is well-known to terminate in the line characteristic impedance; this allows maximum power transfer and eliminates standing wave patterns on the line. The drawback to this choice, however, is that since the line characteristic impedance and the load impedance are equal, a voltage division occurs at each point where a load is connected. Such division need not be a problem if there are only a few loads on the line, but in a situation where the number of loads is indeterminate and the input signal level is fixed, it can cause some loads not to have enough signal for reception.

An alternative to terminating in the line characteristic impedance is to make each load impedance several orders of magnitude higher than the line characteristic impedance. This will prevent a signal from being divided down but it will also cause a substantial standing wave to appear on the line. If the loads are randomly spaced on the line, some loads may be at or near a node in the standing wave and consequently will not receive a signal.

Yet another loading scheme is to make all the load impedances several orders of magnitude higher than the characteristic impedance except for the load at the end of the line which is made equal to the characteristic impedance. This scheme will not cause voltage division nor a standing wave, but the end of each line requires a special load that is different from all the rest. Whenever the loads or luminaires are rearranged or the line is lengthened, the special load must be transferred to the end of the line; this would be an onerous burden.

According to a feature of our invention, we avoid the foregoing problems by making the load impedance presented to the line by the coupling transformer at each luminaire substantially higher than the characteristic impedance of the line but not several orders of magnitude higher. The characteristic impedance of a transmission line is the ratio of voltage to current at any point. It is given approximately by $\sqrt{L/C}$ (ohms), where L (henrys) is the inductance and C (farads), the capacitance per unit length. It is determined primarily by the geometry of the line which includes the size and spacing of the conductors and their distance from a ground plane (e.g., metal conduit). Other factors that affect the characteristic impedance are the permittivity of the medium surrounding the conductors and the presence of other conductors. On a typical distribution line for lighting city streets, the characteristic impedance will be between 25 ohms and 150 ohms, the lower figure applying to underground lines in conduits, and the higher figure to overhead lines.

Figure 2:
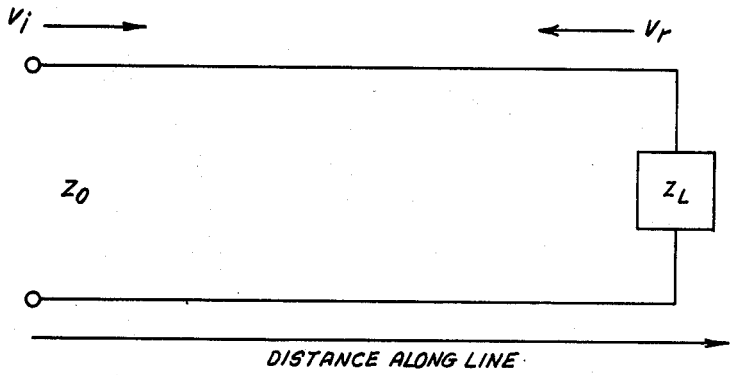
FIG. 2 represents schematically a transmission line terminated in an impedance other than its characteristic impedance.

The general case of a terminated transmission line is represented schematically in FIG. 2 and the following symbol definitions are applicable.

$Z_o$=Characteristic impedance of line
$Z_L$=Terminating (load) impedance
$V_i$=Incident wave
$V_r$=Reflected wave A reflected wave is present if there is a mismatch between the characteristic impedance and the load impedance. The magnitude and phase of the reflected wave $V_r$ is given by $p.V_i$, where p is the reflection coefficient and is given by $$\frac{Z_L - Z_O}{Z_L + Z_O}.$$

Figure 3:
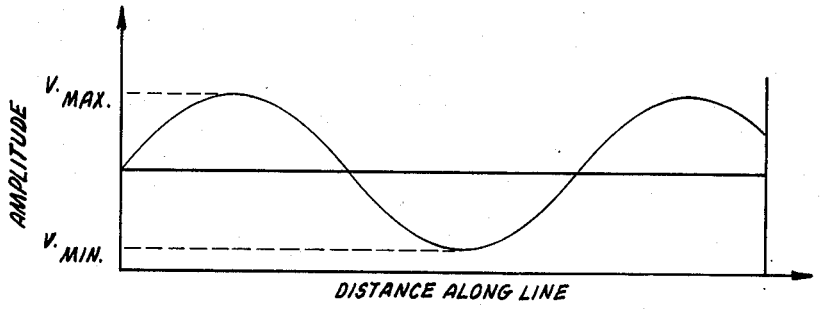
FIG. 3 illustrates the voltage pattern due to a standing wave along the transmission line of FIG. 2.

If the terminating impedance is matched to the line impedance, that is if $Z_L=Z_O$, then p=O and there is no reflected wave. If the terminating impedance is not matched to the line impedance, that is if $Z_L \neq Z_O$, a reflected wave is produced. As the reflected wave travels down the line, it adds to or subtracts from the incident wave, depending on the phase relationship of the two waves. The result is a standing wave along the transmission line as shown in FIG. 3. It will be observed that $V_{max}=V_i+V_r$, and $V_{min}=V_i-V_r$.

To assure signal reception at all points, that is at all luminaires irrespective of location, $V_{min}$ must not drop below some specified level. This can be achieved by selecting a terminating impedance that allows only reflections not exceeding a certain percentage of the incident wave. By way of example, let us assume that an incident voltage of 5 v is supplied to the line, and that minimum or threshold voltage required at any luminaire is 0.2 v.

Since $V_{min}=V_i-V_r=V_i(1-p)$, it must follow that $$p = 1 - \frac{V_{min}}{V_1} = 1 - \frac{.2}{5} = .96.$$

Such value of p means that the reflected wave will not exceed 96% of the incident wave and assures that $V_{min}$ will never be less than the threshold voltage at any point along the line. To select a terminating impedance we convert the equation $$p = \frac{Z_L - Z_O}{Z_L + Z_O} \text{ into } Z_L = \frac{1+p}{1-p} \cdot Z_O. \text{ Applying}$$

Applying the value of 0.96 for p, we obtain $Z_L=49\ Z_O$.

Therefore, to achieve the desired result of a threshold voltage of 0.2 v at any point along the line, for a characteristic impedance $Z_O$ of 25 ohms, a terminating impedance $Z_L$ of 1225 ohms is required; for any greater value of characteristic impedance up to 150 ohms, such value of terminating impedance will result in a smaller reflection coefficient p and hence a $V_{min}$ greater than threshold. Hence a good general rule is to provide a terminating impedance assuring approximately the desired reflection coefficient p at the lowest line characteristic impedance expected to be encountered in a particular installation.

In the circuit of FIG. 1, the actual terminating impedance is of course the parallel combination of the selected resistor $R_o$ and the resistive component of the transformer capacitor combination including resistance reflected in the primary from the secondary side. We have found a value of 2200 ohms for $R_o$ to be a good practical choice, in FIG. 1. The impedance presented to the line by the tuned transformer primary is high, but it includes a lossy component and the line effectively sees a terminating impedance somewhat less than the $R_o$ value of 2200 ohms.

The carrier signal is coupled from the line into the carrier signal or tone detector as follows. The secondary winding of pick-off transformer $T_1$ is connected through series loading resistor $R_2$ (27 kilohms) to the parallel resonant tank circuit formed by adjustable inductor $L_1$ (1 mhy max) and capacitor $C_1$ (680 PFD). Inductor $L_1$ is adjusted to tune the circuit to the carrier signal frequency whereby to reject signals of other frequencies. The tank circuit energizes a peak detector circuit comprising diode $D_2$, bleed-down resistor $R_3$ (100 kilohms), and capacitor $C_2$ (1 UFD). The time constant of $R_3$ and $C_2$ is long compared to the period of a 60 Hz wave so that the output of the peak detector, that is the signal across $C_2$, is essentially a D.C. voltage varying proportionally to the strength of the carrier signal or tone picked off by $T_1$.

The tone detector is supplied with a D.C. operating voltage by a small transformer $T_2$ having its primary connected across the line terminals and its low voltage (12 v) secondary connected across four-diode rectifying bridge BR. The pulsating D.C. output of the bridge is supplied through diode $D_1$ to filter capacitor $C_4$ (82 UFD), and thence to the series combination of resistor $R_1$ (680 ohms) and zener diode $Z_1$, suitably type IN 5239. The constant voltage drop across the reversely connected zener diode produces a regulated filtered D.C. output of about 9 volts.

The output of the peak detector is amplified by operational amplifiers $IC_1$ and $IC_2$ which are differentially connected and cascaded and for which a pair of LM 2904 contained in the same envelope may be used. The regulated 9 volt D.C. output energizes the two operational amplifiers and supplies a reference voltage to the first through the voltage divider formed by $R_4$ and $R_5$, and to the second through the voltage divider formed by $R_7$ and $R_8$. Amplifier $IC_1$ supplies its output through resistor $R_6$ (1 megohm) to amplifier $IC_2$, which in turn supplies its output through resistor $R_9$ to the base of transistor $Q_1$. Relay coil Y is connected across the D.C. output terminals of bridge BR in series with transistor $Q_1$ which is normally biased off. When a carrier signal or tone is received, the amplified signal supplied to the base of transistor $Q_1$ turns it on and the current flow through the relay coil causes normally closed contacts $Y_c$ to open. This action places dimming reactor $L_1$ in series with lamp N, thereby reducing the current and dimming the lamp. Diode $D_3$ prevents voltage build-up across the relay coil when transistor $Q_1$ is suddenly turned off.

Figure 4:
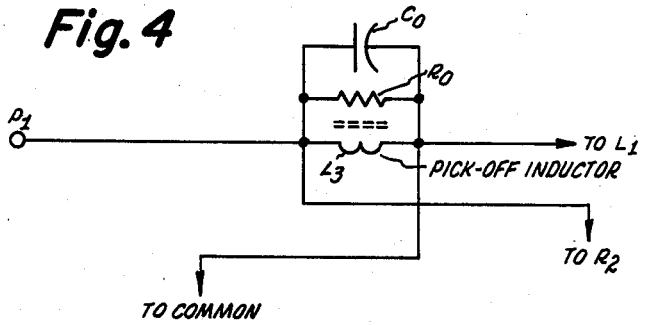
FIG. 4 is a schematic diagram of a portion only of the circuit of FIG. 1 showing a modified tuned inductive device and coupling means.

FIG. 4 illustrates a variant of the invention which utilizes a pick-off inductor $L_3$ in lieu of pick-off transformer $T_1$, other portions being unchanged. As shown, inductor $L_3$ comprising on a ferrite core a few turns of wire having a current carrying capacity adequate to handle the luminaire load current, is connected in series with dimming reactor $L_1$ and ballast reactor $L_2$. The line side of $L_3$ is connected through series loading resistor $R_2$ to the parallel resonant tank circuit formed by adjustable inductor $L_1$ and capacitor $C_1$. The lamp side of $L_3$ is connected to the common or base side of the tone detector circuit. Inductor $L_3$ is tuned by capacitor $C_0$ to the carrier signal frequency, and resistor $R_o$ is selected to achieve the desired terminating impedance value. This variant allows the use of a cheaper inductor in lieu of a transformer but requires more amplification in the tone detector circuit.

It will be appreciated that the value of 2200 ohms which has been selected for the resistor $R_o$ and which results in a terminating impedance $Z_L$ of slightly lower value, is appropriate for the range of characteristic line impedances $Z_O$ from 25 to 150 ohms. For other values or ranges of characteristic line impedance, other choices may be more appropriate. The particular circuits which have been described in detail herein including of course the specific detector circuit and amplifier circuit used in the tone detector are given by way of example only and equivalents may of course be substituted. The scope of the invention is to be determined by the appended claims which are intended to cover any modifications falling within its true spirit.

What I claim as new and desire to secure by Letters Patent of the United States is:

1. A circuit coupling an RF carrier signal into a signal utilization circuit from an AC power line supplying an electric discharge lamp circuit including ballast means for limiting the current through said lamp, comprising:

an inductive device having a high current capacity winding being coupled to said power line and connected in series with at least a portion of said electric discharge lamp circuit, said inductive device developing across its said winding a signal proportionate to said RF signal, said inductive device presenting a low capacitive impedance to said RF carrier signal, resistive means coupled to said inductive device causing it to present to the power line a terminating impedance higher than the characteristic impedance of the power line, said terminating impedance having a value selected so that a minimum or threshold voltage will appear at any point along said power line of a sufficient value to assure development by said inductive device of said signal proportionate to said RF carrier signal, and means coupling the proportionate RF carrier signal developed across said inductive device into said signal utilization circuit.

2. A circuit as in claim 1 wherein said inductive device is a pick-off transformer having a high current capacity primary winding connected in series with said portion of said lamp circuit, and a secondary winding serving as said coupling means.

3. A circuit as in claim 1 wherein said inductive device is a pick-off reactor connected in series with said portion of said lamp circuit, and wherein connections to opposite sides of said pick-off reactor serve as said coupling means.

4. A circuit as in claim 1 further comprising:

capacitive means in parallel with the inductive device having a value selected to cause resonating of the inductive device at the frequency of said RF carrier signal.

5. A circuit coupling an RF carrier signal into a utilization circuit from an AC power line supplying a ballasting means for an electric discharge lamp, comprising:

a pick-off transformer having a high current capacity primary winding being coupled to said AC power line and which is connected in series with said ballasting means across terminals adapted to be connected to said power line, a capacitor connected across said primary winding, said capacitor having a value selected to cause resonating of the primary magnetizing reactance of said pick-off transformer at the frequency of said RF carrier signal, resistive means coupled to said pick-off transformer causing it to present to the power line a terminating impedance higher than the characteristic impedance of the power line, said terminating impedance having a value selected so that a minimum or threshold voltage will appear at any point along said power line of a sufficient value to assure development by said pick-off transformer of said signal proportionate to said RF carrier signal, and a secondary winding in said pick-off transformer connected to a utilization circuit for supplying the proportionate RF carrier signal thereto.

6. A circuit as in claim 5 wherein the utilization circuit comprises a loading resistor connected in series with an L-C tank circuit across said secondary winding, said tank circuit being tuned to the frequency of said carrier signal, a peak detector circuit connected across said tank circuit and responsive to the presence of said carrier signal, and means for amplifying the output of said peak detector.

7. A circuit for coupling an RF carrier signal into a utilization circuit from an AC power line supplying a ballasting means for an electric discharge lamp, comprising:

a pick-off transformer having a high current capacity primary winding capable of being coupled to said AC power line and which is connected in series with said ballasting means across terminals adapted to be connected to said power line, a capacitor connected across said primary winding, said capacitor having a value selected to cause resonating of the primary magnetic reactance of said transformer at the frequency of said RF carrier signal, resistive means coupled to said pick-off transformer causing it to present to the power line a terminating impedance higher than the characteristic impedance of the line, said terminating impedance having a value of approximately $$\frac{1+p}{1-p}$$

times the lowest line characteristic impedance of any of the power lines capable of supplying said ballasting means, p being a reflection coefficient proportionate to said terminating and characteristic impedances so that a minimum or threshold voltage will appear at any point along the power line of a sufficient value to assure development by said pick-off transformer of said signal proportionate to said RF carier signal.

8. An operating and control circuit with an electric discharge lamp connected across an AC power line to which an RF carrier signal is supplied comprising:

ballasting means having an output circuit for starting and operating an electric discharge lamp, dimming reactance means switchably connected to said ballasting means, a pick-off transformer having a high current capacity primary winding capable of being coupled to said AC power line and which is connected in series with said ballasting means across terminals adapted to be connected to said power line, said pick-off transformer developing across its said primary winding a signal proportionate to said RF carrier signal, a capacitor connected across said primary winding, said capacitor having a value selected to cause resonating of the primary magnetizing reactance of said transformer at the frequency of said RF carrier signal, a secondary winding in said pick-off transformer for supplying the signal proportionate to said RF carrier to a detector circuit, resistive means coupled to said inductive device causing it to present to the power line a terminating impedance higher than the characteristic impedance of the power line, said terminating impedance having a value selected so that a minimum or threshold voltage will appear at any point along said power line of a sufficient value to assure development by said pick-off transformer of said signal proportionate to said RF carrier signal, and switching means controlled by said detector circuit for switching said dimming reactance means into circuit in order to dim said lamp.

9. An operating and control circuit as in claim 8 wherein said detector circuit comprises an L-C tank circuit tuned to the frequency of said carrier signal and connected in series with a loading resistor across said secondary winding, a peak detector circuit connected across said tank circuit, and means for amplifying the output of said peak detector and supplying it to said switching means.

10. A circuit coupling an RF carrier signal into a signal utilization circuit from an AC power line supplying an electric discharge lamp circuit including ballasting means for limiting the current through said circuit, comprising:

an inductive device having a high current capacity winding being coupled to said AC power line and connected in series with a portion of said electric discharge lamp circuit, said inductive device developing across its said windings a signal proportionate to said RF carrier signal, said inductive device presenting a low capacity impedance to said RF carrier signal, resistive means coupled to said inductive device causing it to present to the power line a terminating impedance higher than the characteristic impedance of the power line, said terminating impedance having a value of approximately $$\frac{1+p}{1-p}$$

times the lowest line characteristic impedance of any of the AC power lines capable of supplying said discharge lamp circuit, p being a reflection coefficient proportionate to said terminating and characteristic impedances so that a minimum or threshold voltage will appear at any point along said power line of a sufficient value to assure development by said inductive device of said signal proportionate to said RF carrier signal, and means coupling the proportionate RF carrier signal developed across said inductive into said signal utilization circuit.

* * * * *